US011745218B2

(12) United States Patent
van Mechelen et al.

(10) Patent No.: US 11,745,218 B2
(45) Date of Patent: Sep. 5, 2023

(54) CORRECTIVE COATING OF OBJECTS

(71) Applicant: ABB Schweiz AG, Baden (CH)

(72) Inventors: Jacobus Lodevicus Martinus van Mechelen, Regensdorf (CH); Andreas Frank, Zürich (CH); Deran Maas, Zürich (CH)

(73) Assignee: ABB Schweiz AG, Baden (CH)

( * ) Notice: Subject to any disclaimer, the term of this patent is extended or adjusted under 35 U.S.C. 154(b) by 346 days.

(21) Appl. No.: 17/281,826

(22) PCT Filed: Nov. 30, 2018

(86) PCT No.: PCT/EP2018/083079
§ 371 (c)(1),
(2) Date: Mar. 31, 2021

(87) PCT Pub. No.: WO2020/108766
PCT Pub. Date: Jun. 4, 2020

(65) Prior Publication Data

US 2022/0016671 A1 Jan. 20, 2022

(51) Int. Cl.

| | |
|---|---|
| ***B05D 7/00*** | (2006.01) |
| ***B05B 12/08*** | (2006.01) |
| *B05B 13/04* | (2006.01) |

(52) U.S. Cl.
CPC ..... *B05D 7/534* (2013.01); *B05B 12/084* (2013.01); *B05B 13/0452* (2013.01)

(58) Field of Classification Search
CPC ..... B05D 7/534; B05D 7/52; B05B 12/084; B05B 13/0452
See application file for complete search history.

(56) References Cited

U.S. PATENT DOCUMENTS 6,128,081 A 10/2000 White et al.
6,528,109 B1 3/2003 Filev et al.
(Continued)

FOREIGN PATENT DOCUMENTS

WO 2016156700 A1 10/2016
WO 2016172316 A1 10/2016
(Continued)

OTHER PUBLICATIONS

International Search Report and Written Opinion of the International Searching Authority; Application No. PCT/EP2018/083079; Completed: Jul. 18, 2019; dated Jul. 25, 2019; 13 Pages.
(Continued)

*Primary Examiner* — Hai Y Zhang
(74) *Attorney, Agent, or Firm* — WHITMYER IP GROUP LLC

(57) ABSTRACT

A method for coating objects starts with dispensing, by means of a first painting system, a first coating layer on a first object. A property of the first coating layer is measured to thereby obtain a first property value, and a coating variable of a second painting system is adjusted based on the first property value. A second coating layer is dispensed on the first coating layer by means of the second painting system which is different from the first painting system. By providing a measurement between the two painting systems, and by adjusting the coating parameters of the downstream painting system based on the measurement results, the overall coating can be corrected by compensating by means of the downstream painting system for a defective coating dispensed by the upstream painting system.

15 Claims, 1 Drawing Sheet

(56) References Cited

U.S. PATENT DOCUMENTS

| | | | | |
|---|---|---|---|---|
| 2011/0094444 | A1 | 4/2011 | Haas et al. | |
| 2017/0036232 | A1 | 2/2017 | Hoffman et al. | |
| 2018/0149634 | A1* | 5/2018 | Dattilo | G06Q 10/06 |

FOREIGN PATENT DOCUMENTS

| | | | | |
|---|---|---|---|---|
| WO | WO-2016172316 | A1 * | 10/2016 | B05B 12/00 |
| WO | 2019073074 | A1 | 4/2019 | |

OTHER PUBLICATIONS

European Office Action; Application No. 18814833; Completed Jan. 3, 2023; 6 Pages.

* cited by examiner

CORRECTIVE COATING OF OBJECTS

TECHNICAL FIELD

The present invention relates to coating, such as painting, in a painting line of a mass production facility.

BACKGROUND

It is well known in the art to provide painting lines with a plurality of subsequent paint booths configured to dispense different coatings on objects transported through the painting line on a conveyor. Each paint booth typically comprises a painting system with at least one painting robot carrying a paint dispenser, a paint delivery system containing the paint itself, and a controller controlling the operations of the different parts of the painting system including adjustment of coating parameters of the same. The coating parameters may comprise paint volume flow, spraying air flow, shaping air flow, bell speed, electrical charge of the paint haze, robot position, robot speed, paint viscosity, paint colour, etc.

It is furthermore known e.g., from US20110094444A1 and WO2016156700A1 to provide a painting line with measurement stations between two subsequent paint booths. The measurement stations are configured to measure at least one property of the coating layer dispensed on the respective object. The at least one property typically comprises at least the thickness. According to the teachings of US20110094444A1 and WO2016156700A1 the measurement results are provided as feedback to adjust coating parameters of the preceding painting system responsible for the dispensing of the measured coating layer. The coating layers on the subsequent objects can thereby be adjusted based on the measurement results.

It is furthermore known e.g., from US20170036232A1 to provide a paint booth which in addition to a painting system comprises a measurement system, and wherein the dispensed coating is corrected within the same paint booth. Based on the measurement results the coating parameters of the respective painting system are adjusted to correct the coating dispensed by it thus far. US20170036232A1 particularly concerns products with complex geometry and of small series.

There remains a desire to improve the existing painting lines to enable improved correction of a dispensed coating.

SUMMARY

One object of the invention is to provide an improved method for coating an object. Particularly, the object of the invention is to provide a coating method that enables correction of a defective coating in a painting line of a mass production facility.

A further object of the invention is to provide an improved painting infrastructure.

These objects are achieved by the method according to the invention.

The invention is based on the realization that by providing a measurement between two painting systems in a painting line, and by adjusting the coating parameters of the downstream painting system based on the measurement results, the overall coating can be corrected by compensating by means of the downstream painting system for a defective coating dispensed by the upstream painting system.

According to a first aspect of the invention, there is provided a method for coating objects. The method comprises the steps of: dispensing, by means of a first painting system, at least a first coating layer on a first object; measuring at least one property of the first coating layer to thereby obtain at least one first property value; adjusting, based on the at least one first property value, at least one coating variable of a second painting system; and dispensing, by means of the second painting system, at least a second coating layer on a first coating layer of a second object. The second painting system is different from the first painting system.

According to one embodiment of the invention, the step of measuring is executed while the first coating layer is at least partially wet.

According to one embodiment of the invention, the at least one property comprises at least one of the following: thickness, colour, gloss, paint composition.

According to one embodiment of the invention, the at least one coating variable comprises at least one value of at least one of the following coating parameters: paint volume flow, spraying air flow, shaping air flow, bell speed, voltage level, robot position, robot speed, paint viscosity, paint colour.

According to one embodiment of the invention, the adjustment is based on experience from earlier adjustments, the results of the earlier adjustments being saved in a painting database made available to a plurality of painting systems.

According to one embodiment of the invention, the method further comprises the steps of: measuring at least one property of the second coating layer or of the combination of the first and second coating layers to thereby obtain at least one second property value, and saving the at least one second property value in a painting database made available to a plurality of painting systems.

According to one embodiment of the invention, the method further comprises the step of calculating, on the basis of the at least one second property value, at least one coating variable value for the second painting system.

According to one embodiment of the invention, the method further comprises the step of saving the at least one coating variable value in the painting database without an intention to use it for a specific adjustment.

According to one embodiment of the invention, the second painting system is part of a different painting line than the first painting system.

According to one embodiment of the invention, the first painting system and the second painting system are in different and geographically remote sites.

According to one embodiment of the invention, the first object and the second object are one and the same object.

According to a second aspect of the invention, there is provided a painting infrastructure comprising: a first painting system configured to dispense at least a first coating layer on a first object, a second painting system configured to dispense at least a second coating layer on a first coating layer of a second object, the second painting system being different from the first painting system, and a measurement station configured to measure at least one property of the first coating layer to thereby obtain at least one first property value. The painting infrastructure further comprises a painting database configured to receive the at least one first property value, and to return at least one coating variable for the second painting system based on the at least one first property value.

According to one embodiment of the invention, the painting database comprises a memory for saving the at least one first property value, and a computer algorithm configured to calculate at least one coating variable for the second painting system based on the at least one first property value and on at least one earlier saved first property value.

According to one embodiment of the invention, the second painting system is configured to dispense at least a second coating layer on the first coating layer of the first object.

BRIEF DESCRIPTION OF THE DRAWINGS

The invention will be explained in greater detail with reference to the accompanying drawings, wherein.

DETAILED DESCRIPTION

Figure 1:
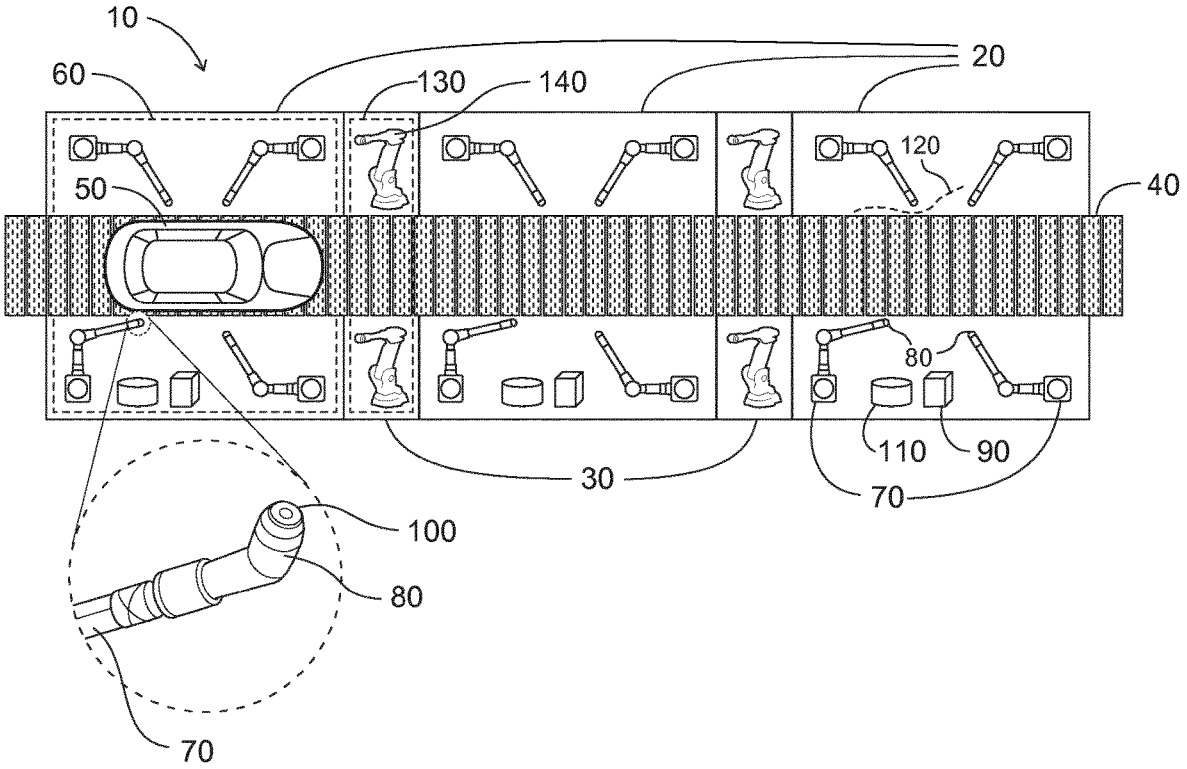
FIG. 1 shows a painting line according to one embodiment of the invention.

Referring to FIG. 1, a painting line 10 according to one embodiment of the invention comprises three paint booths 20 arranged one after another. There is a measurement station 30 between each pair of adjacent paint booths 20. A conveyor 40 continuously transports vehicle bodies 50 to be painted through the painting line 10, and each paint booth 20 comprises a painting system 60 configured to dispense a layer of paint or other coating on the vehicle bodies 50. The first painting system 60 may for example be configured to dispense a first base coat, the second painting system 60 may be configured to dispense a second base coat, and the third painting system 60 may be configured to dispense a first clear coat on the vehicle bodies 50. In addition to the shown paint booths 20 and measurement stations 30 the painting line 10 may comprise additional paint booths 20 and measurement stations 30, flash-off zones, ovens, and other painting line elements known as such in the technical field of painting.

Each painting system 60 may comprise an appropriate number of painting robots 70 each equipped with a paint atomizer 80, and a controller 90 controlling the operations of the different parts of the painting system 60 including adjustment of coating parameters of the same. Each paint booth 20 may also be considered to be part of the respective painting system 60 provided that some parameters of the paint booth 20, such as the booth temperature, booth humidity and booth pressure (temperature, humidity and pressure of the air within the paint booth 20), affecting the resulting coating, are adjusted by the respective controller 90.

Each paint atomizer 80 may for example be of a bell type, wherein a bell-shaped atomizing head 100 rotates at a high speed to turn a liquid paint delivered to the atomizing head 100 into small droplets directed towards the vehicle body 50 to be painted. Each paint atomizer 80 may furthermore be designed for electrostatic painting, wherein the paint atomizer 80 comprises at least one electrode (not shown) charged with high electric voltage. Such paint atomizers 80 are well known in the art e.g., from WO2009069396A1. The paint is delivered to the atomizing head 100 by a respective paint delivery system containing a reservoir 110 and at least one pump (not shown). The volume flow of each different paint or other coating to be dispensed can be adjusted by means of the controller 90. The properties of each paint can be adjusted e.g., by adding agents in the respective reservoir 110 or by adjusting the temperature of the same.

However, even if an example of a painting system 60 is here disclosed to a certain detail, the compositions of the painting systems 60 are not interesting or significant for the present invention. The above example of a painting system 60 is there merely to illustrate that depending on the painting system 60 there is a large number of all kinds of coating parameters affecting the resulting coating. In the case of the above example at least the following coating parameters can be identified: robot positions constituting robot paths 120, robot speeds, rotational speeds of the atomizing heads 100, electrical charge of the paint haze tuned by voltage levels at the electrodes, volume flow of the paint, paint viscosity, paint colour, paint temperature, booth temperature, booth humidity and booth pressure.

It is to be understood that an arbitrary painting system 60 does not need to comprise all the coating parameters mentioned here, and that it may comprise many additional coating parameters not mentioned here. It is also to be understood that the values of at least some coating parameters may vary during work cycles of each respective painting system 60, and in the context of the present disclosure a "set of coating variables" shall be considered to comprise all the values of all respective coating parameters over a work cycle, a "coating variable" shall be considered to comprise all the values of a single coating parameter over a work cycle, and a "coating variable value" shall be considered to comprise an instant value of a single coating parameter during a work cycle. Moreover, all parameters that can be, and are, adjusted by the controllers 90, and that affect the resulting coating, shall be considered as coating parameters. For example, the booth temperature, booth humidity and booth pressure may also be so called environmental variables that can be measured but not controlled, in which case they shall not be considered as coating parameters.

Further referring to FIG. 1, the first painting system 60 may be configured to dispense a first base coat on a first vehicle body 50 using a first set of coating variables. As soon as this is done, the conveyor 40 transports the first vehicle body 50 (possibly via a flash-off zone or another additional painting line element) to the first measurement station 30. The first measurement station 30 may comprise a first measurement system 130 with an appropriate number of THz sensors (not shown), known as such e.g., from EP2899498A1, emitting THz radiation towards the first base coat and detecting the returning radiation having interacted with the first base coat. Each THz sensor is carried by a measuring robot 140 moving the respective sensor in relation to the first vehicle body 50 to make measurements at a plurality of locations of the first base coat.

THz sensors are preferable in that the measurements are based on THz time-domain spectroscopy which is well suited for measuring wet or partially wet coatings. Alternatively, the measurement may be based e.g., on photothermal sensing or optical coherence spectroscopy, both, as well as THz time-domain spectroscopy, as such being well-known methods in the technical field of painting. The first measurement system 130 is configured to measure at least the thickness of the first base coat, and thereby at least one first property (thickness) value is obtained. Preferably also other properties such as colour, gloss and paint composition are measured, and thereby at least one additional first property value is obtained. Preferably for each measured property (including the thickness) a large number of first property values at different locations of the first base coat are obtained.

After the first measurement station 30 the conveyor 40 transports the first vehicle body 50 (possibly via a furnace or another additional painting line element) into the second paint booth 20 which may comprise a second painting system 60 substantially identical with the first painting system 60. The second painting system 60 may be configured to dispense a second base coat on the first base coat (and on the first vehicle body 50) using a second set of coating variables. Under the transportation time between the first measurement station 30 and the second paint booth 20 the second set of coating variables may be adjusted based on the measured at least one first property value.

For example, if the thickness of the first base coat at a first location is measured to be under a threshold value, one or more of the coating variables in the second set of coating variables may be adjusted in order to compensate for the too thin first base coat by making the second base coat respectively thicker at the first location. The overall thickness of the first base coat and the second base coat can thereby be corrected to be within limit values (between upper and lower threshold values). The relevant coating parameter to be adjusted may be e.g., paint volume flow (the higher volume flow the larger thickness), robot position (the shorter dispensing distance the larger thickness), robot speed (the slower speed the larger thickness), or a combination of the same. It is however to be understood that there are many other coating parameters affecting the thickness of the second base coat. Moreover, there may be other properties that are defective and can be compensated for by adjusting the second set of coating variables.

It is to be understood that also the first set of coating variables may be adjusted based on the measured thickness of the first base coat at the first location in order to correct the thickness to end up within the limit values. However, such correction does not serve for compensation of the measured defective first base coat but only allows for correction of corresponding subsequent first base coats.

Further referring to FIG. 1, as soon as the second painting system 60 has dispensed the second base coat on the first base coat, the conveyor 40 transports the first vehicle body 50 (possibly via a flash-off zone or another additional painting line element) to the second measurement station 30 which may comprise a second measurement system 130 substantially identical with the first measurement system 130. The second measurement system 130 is configured to measure at least the thickness of the second base coat, and thereby at least one second property (thickness) value is obtained. Preferably also other properties such as colour, gloss and paint composition are measured, and thereby at least one additional second property value is obtained. Preferably for each measured property (including the thickness) a large number of second property values at different locations of the second base coat are obtained.

After the second measurement station 30 the conveyor 40 transports the first vehicle body 50 (possibly via a furnace or another additional painting line element) into the third paint booth 20 which may comprise a third painting system 60 substantially identical with the first and second painting systems 60. The third painting system 60 may be configured to dispense a first clear coat on the second base coat (and on the first vehicle body 50) using a third set of coating variables. Under the transportation time between the second measurement station 30 and the third paint booth 20 the third set of coating variables may be adjusted based on the measured at least one second property value.

For example, if the overall thickness of the first base coat and the second base coat at a first location is measured to be over a threshold value, one or more of the coating variables in the third set of coating variables may be adjusted in order to compensate for the too thick overall thickness of the first base coat and the second base coat by making the first clear coat respectively thinner at the first location. The overall thickness of the first base coat, the second base coat and the first clear coat can thereby be corrected to be within limit values.

Figure 2:
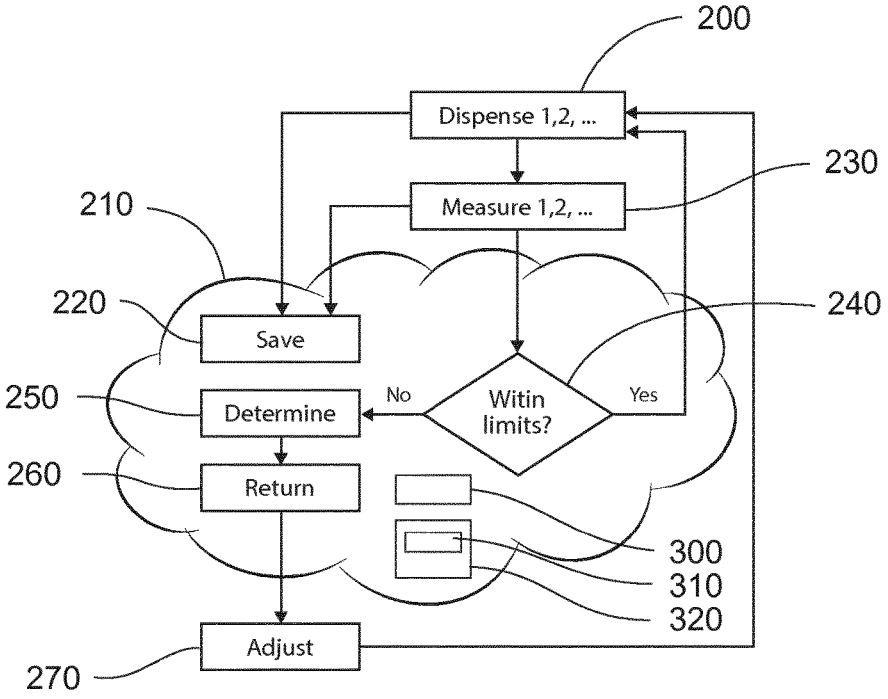
FIG. 2 shows flow chart illustrating a method according to one embodiment of the invention.

Referring to FIG. 2, method for painting a vehicle body 50 according to one embodiment of the invention begins with the step of dispensing 200, by means of a first painting system 60 using a first set of coating variables, a first base coat on a first vehicle body 50. The respective controller 90 sends the first set of coating variables to a painting database 210 at a cloud server where it is saved 220 in a memory 300. The painting database 210 may contain a large number of different sets of coating variables used over time for painting systems 60 in the actual painting line 10, and in addition it can contain different sets of coating variables used over time for painting systems 60 in other painting lines 10 at remote sites. The painting database 210 may e.g., contain all the sets of coating variables used over certain period of time for all painting systems 60 in all painting lines 10 of one car manufacturer. The painting database 210 is made available to all controllers 90 connected to it such that the controllers 90 can receive sets of coating variables from the painting database 210.

The painting database 210 may thereby contain a considerable amount of painting data constituting big data. The painting database 210 may also contain a computer algorithm 310 for calculating new sets of coating variables based on ongoing updates of the painting database 210, and the thereby obtained sets of coating variables can be saved 220 in the painting database 210 for future use. The painting database 210 may thereby also contain sets of coating variables that have never been used to adjust coating parameters in a painting system 60, and that potentially never will be used either. The computer algorithm 310 preferably uses statistical information gathered from the big data. The painting database 210 preferably also contains one or more processors 320 with enough calculation power for fast execution of the computer algorithm 310.

Further referring to FIG. 2, at the step of measuring 230 the thickness may be measured 230 at one hundred different locations of the first base coat to obtain one hundred first thickness values. The one hundred locations are preferably representative of the first vehicle body 50 and include locations which are known to frequently comprise defective coating thickness, such as highly curved, thin, non-metallic, and shadowed areas. The first thickness values are saved 220 at the painting database 210 and compared 240 with upper and lower threshold limits to establish whether they are within limit values at the one hundred locations. If the first thickness values are outside of the limit values at least one location, the painting database 210 attempts to determine 250 an appropriate second set of coating variables in order to compensate for the deviation and returns 260 it to the respective controller 90 which adjusts 270 the respective coating parameters.

The painting database 210 may use any appropriate method for determining 250 an appropriate second set of coating variables. Preferably the painting database 210 chooses at least a part of the second set of coating variables among the content of the painting database 210 i.e., among the sets of coating variables saved 220 in the painting database 210. The selection may e.g., be based on an earlier defect that corresponds to the current defect and that was successfully compensated for. The big data may namely already contain solutions as to how to compensate for the specific defect(s) at the specific location(s), and in such case it may not be necessary to calculate a completely new second set of coating variables. However, the computer algorithm 310 may also calculate a completely or partially new second set of coating variables on the basis of the defect that is detected. It is also possible to guess or randomly choose at least parts of coating variables.

For example, a too small first thickness value at a first location may already earlier be successfully compensated for in another (or in the same) painting system 60, and experience from the earlier compensation may be utilized by making a similar compensation of coating variable values corresponding to the first location in the current second set of coating variables. The first painting system 60 that dispensed 200 the earlier defective first base coat may thereby be part of a different painting line 10 than the second painting system 60 that utilizes the earlier experience to correct a similar defect. The first painting system 60 and the second painting system 60 may for example be in different and geographically remote sites, such as in different countries or on different continents.

Assuming that the earlier compensation was successful but not perfect (the overall thickness of the first base coat and the second base coat was corrected to end up within the limit values, but still deviates from a reference value corresponding to a perfect result), the earlier compensation may be improved by further adjusting the coating variable values corresponding to the first location of the earlier second set of coating variables, and by using the so adjusted coating variable values in the current second set of coating variables. Even unsuccessful corrections can be utilized to improve the success rate of subsequent corrections; a failed correction result may suggest that a certain coating variable shall not be adjusted, or that the certain coating variable shall be adjusted to opposite direction.

The painting database 210 preferably contains a computer algorithm 310 that is self-learning, and thereby capable of continuously improving the average success rate. Furthermore, the computer algorithm 310 is preferably capable of recognizing slow drifts in the measured 230 properties over time, and capable of taking corrective measures. For example, if the first base coat gets thinner and thinner yet remains within limit values in a series of measurements, it is preferable that the computer algorithm 310 suggests corrective measures before the thickness of first base coat gets under the lower threshold value.

The determination of whether or not a correction is considered successful is based on measurements directly after each correction, and so is the content of any further adjustment of coating parameters. Each time a new correction and a corresponding measurement take place the painting database 210 is updated with new information that can be utilized by all painting systems 60 connected to the painting database 210. A further advantage resulting from execution of the measurements directly after each dispensing 200 of a paint layer is that a vehicle body 50 requiring rework or destruction can be picked aside from the painting line 10 without a non-productive occupation of the remaining painting line elements and without the corresponding waste of paint. A yet further advantage is that a defect that potentially will be hidden by subsequent paint layers can be detected. For example, if a measurement system 130 is only able to measure 230 the overall thickness of all dispensed 200 paint layers, information of a too thin first base coat under two additional paint layers goes lost.

Considering the large number of potential coating parameters and possible environmental parameters, it may be an extremely difficult task to adjust the coating variables in right direction. In the worst-case subsequent adjustments may cause a run-away effect where the results get worse and worse, which may lead to rework or even destruction of the objects to be painted. A conservative adjustment strategy involving an experienced human operator may be preferred at least until the painting database 210 contains enough data and a computer algorithm 310 whose reliability is confirmed. A human operator may e.g., confirm every adjustment suggested by the computer algorithm 310 at the build-up phase of the painting database 210, and as the painting database 210 hopefully gets more and more reliable, the human involvement may be decreased.

As transportation time between a measurement station 30 and a subsequent paint booth 20 may be relatively short, it may not always be possible to adjust the respective coating parameters to respond to the latest measurements. This is particularly the case where a human involvement is necessary, but because of the potentially excessive amount of data and long calculation time this may also become an issue where no human involvement is necessary. It may for example happen that the painting database 210 is able to provide an earlier (successful) set of coating variables but does not have time to further adjust the same. In such case the respective painting system 60 may use the earlier set of coating variables, its current set of coating variables, or a default set of coating variables, or a combination of the same (e.g., by combining coating variable values from two different sets of coating variables to form a new set of coating variables), until better information is available.

For example, if the thickness of the first base coat at a first location is measured 230 to be 0.01 mm under a threshold value, the painting database 210 will attempt to return 260 an appropriate second set of coating variables for a subsequent second painting system 60 about to dispense 200 the second base coat. The painting database 210 may e.g., identify an earlier case where the thickness of the first base coat at the first location was measured 230 to be 0.005 mm under the threshold value. According to the earlier case robot speed values corresponding to the first location were decreased from 0.20 m/s to 0.18 m/s, which resulted in that the overall thickness of the first base coat and the second base coat was corrected to be within limit values, but this time 0.005 mm over a reference value.

The computer algorithm 310 may now start to calculate, based on the experience from the earlier case, appropriate robot speed values (corresponding to the first location) for the current situation where the thickness of the first base coat is measured 230 to be 0.01 mm under the threshold value. However, this calculation may take too long to be executed before the first vehicle body 50 to be painted arrives in the second paint booth 20. The painting database 210 may then just suggest the robot speed values from the earlier case i.e., 0.18 m/s to be used as the robot speed values (corresponding to the first location) in the second set of coating variables as such adjustment appears to compensate for the too thin first base coat for approximately the right amount in the right direction. After a subsequent measurement of the thickness of the second base coat at the second measurement station 30 the computer algorithm 310 will be in the position to make an even more precise calculation based on the experience from both the earlier case and the current case, the results of which can be utilized in future adjustments. That is, the computer algorithm 310 may calculate, on the basis of the measured 230 thickness of the second base coat, a new second set of coating variables. However, at the time of the calculation there is no intention to use the new second set of coating variables for adjusting specific coating parameters of a specific painting system 60, and potentially it will never be used for an adjustment of any painting system 60.

It is of course desirable to also adjust the first set of coating variables such that the thicknesses of subsequent first base coats at the first location end up within the limit values. The first set of coating variables may indeed be adjusted based on the measured 230 defective first base coat thickness, not only in the painting system 60 which dispensed 200 the defective first base coat, but also in all other substantially identical painting systems 60 connected to the painting database 210.

The invention is not limited to the embodiments shown above, but the person skilled in the art may modify them in a plurality of ways within the scope of the invention as defined by the claims.

The invention claimed is:

1. A method for coating objects, the method comprising the steps of:

dispensing, by a first painting system, at least a first coating layer on a first object;

measuring at least one property of the first coating layer to thereby obtain at least one first property value;

adjusting, based on the at least one first property value, at least one coating variable of a second painting system; and dispensing, by the second painting system, at least a second coating layer on a first coating layer of a second object;

wherein the second painting system is different from the first painting system.

2. The method according to claim 1, wherein the step of measuring is executed while the first coating layer is at least partially wet.

3. The method according claim 2, wherein the at least one property includes at least one of the following: thickness, colour, gloss, paint composition.

4. The method according to claim 2, wherein the at least one coating variable includes at least one value of at least one of the following coating parameters: paint volume flow, spraying air flow, shaping air flow, bell speed, electrical charge of the paint haze, robot position, robot speed, paint viscosity, paint colour.

5. The method according to claim 2, wherein the adjustment is based on experience from earlier adjustments, the results of the earlier adjustments being saved in a painting database made available to a plurality of painting systems.

6. The method according to claim 2 further comprising the steps of:

measuring at least one property of the second coating layer or of the combination of the first and second coating layers to thereby obtain at least one second property value, and saving the at least one second property value in a painting database made available to a plurality of painting systems.

7. The method according claim 1, wherein the at least one property includes at least one of the following: thickness, colour, gloss, paint composition.

8. The method according to claim 1, wherein the at least one coating variable includes at least one value of at least one of the following coating parameters: paint volume flow, spraying air flow, shaping air flow, bell speed, electrical charge of the paint haze, robot position, robot speed, paint viscosity, paint colour.

9. The method according to claim 1, wherein the adjustment is based on experience from earlier adjustments, the results of the earlier adjustments being saved in a painting database made available to a plurality of painting systems.

10. The method according to claim 1 further comprising the steps of:

measuring at least one property of the second coating layer or of the combination of the first and second coating layers to thereby obtain at least one second property value, and saving the at least one second property value in a painting database made available to a plurality of painting systems.

11. The method according to claim 10 further including the step of calculating, on the basis of the at least one second property value, at least one coating variable value for the second painting system.

12. The method according to claim 11 further including the step of saving the at least one coating variable value in the painting database without an intention to use it for a specific adjustment.

13. The method according to claim 1, wherein the second painting system is part of a different painting line than the first painting system.

14. The method according to claim 1, wherein the first painting system and the second painting system are in different and geographically remote sites.

15. The method according to claim 1, wherein the first object and the second object are one and the same object.

* * * * *